United States Patent [19]

Fukuzuka et al.

[11] Patent Number: 4,851,054

[45] Date of Patent: Jul. 25, 1989

[54] METHOD OF PRODUCING ROLLED STEEL HAVING EXCELLENT RESISTANCE TO SULFIDE STRESS CORROSION CRACKING

[75] Inventors: Toshio Fukuzuka; Kazutoshi Shimogori, both of Kobe; Yasushi Torii, Hyogo; Kohjiro Kitahata; Takuo Hosoda, both of Akashi, all of Japan

[73] Assignee: Kabushiki Kaisha Kobe Seiko Sho, Kobe, Japan

[21] Appl. No.: 147,622

[22] Filed: Jan. 22, 1988

Related U.S. Application Data

[63] Continuation of Ser. No. 850,064, Apr. 7, 1986, abandoned, which is a continuation of Ser. No. 495,500, May 17, 1983, abandoned.

[30] Foreign Application Priority Data

May 18, 1982 [JP] Japan ..... 57-84553

[51] Int. Cl.[4] ..... C21D 8/00

[52] U.S. Cl. ..... 148/12 F; 148/12.3

[58] Field of Search ..... 148/12 F, 12.3, 328, 148/331, 332, 333, 334, 335, 336; 420/128, 126, 127

[56] References Cited

U.S. PATENT DOCUMENTS 4,415,376 11/1983 Bramfitt et al. ..... 148/12 F

FOREIGN PATENT DOCUMENTS 21349 1/1981 European Pat. Off. ..... 148/36

28331 2/1980 Japan ..... 148/12 F 119152 9/1980 Japan ..... 148/12 F 3655 1/1981 Japan ..... 75/123 J

OTHER PUBLICATIONS

Greday et al., "The Combined Effect of Microalloying Steels with Columbium and Vanadium", Micro Alloying 75, Session 1, Wednesday, Oct. 1, 1975, Washington D.C., pp. 145–158.

Gray, "Precipitation in Mild Steels Containing Small Additions of Niobium", Journal of the Iron & Steel Institute, Aug. 1965, pp. 812–818.

*Primary Examiner*—Deborah Yee

*Attorney, Agent, or Firm*—Oblon, Spivak, McClelland, Maier & Neustadt

[57] ABSTRACT

Disclosed herein is a rolled steel having excellent resistance to sulfide stress corrosion cracking. It comprises 0.20–0.40 wt. % C, ≦0.50 wt. % Si, ≦1.90 wt. % Mn, ≦0.06 wt. % Al, 0.0030–0.0090 wt. % N, 0.005–0.10 wt. % Nb, 0.005–0.050 wt. % Ti, and the balance iron and inevitable impurities. The rolled steel contains at least $4\times10^8$ ultrafine carbonitride particles or 0.1 μm or smaller per $mm^3$ as a result that a bloom or slab having the above components is soaked, subjected at 1200°–950° C. to rough rolling under conditions of a total reduction percentage of 75% or lower, cooled at a cooling rate of 1.5° C./sec. or higher after completion of the rough rolling and until the initiation of finish rolling, and then completed with its final rolling above the $A_1$ transformation temperature. A process for producing the above rolled steel is also disclosed.

16 Claims, 1 Drawing Sheet

METHOD OF PRODUCING ROLLED STEEL HAVING EXCELLENT RESISTANCE TO SULFIDE STRESS CORROSION CRACKING

This application is a continuation of application Ser. No. 850,064, filed on 4/7/86 which is a continuation of 495,500 filed 5/17/83, both now abandoned.

BACKGROUND OF THE INVENTION (1) Field of the Invention

This invention relates to a rolled steel having excellent resistance to sulfide stress corrosion cracking and a process for producing same.

(2) Description of the Prior Art

While a rolled steel is used under stress loads in a wet $H_2S$ environment, hydrogen which has been formed due to progress of corrosion reactions penetrates into the steel and accumulates at a location where stresses are centralized. Due to its synergistic effect with stresses, a type of hydrogen embrittlement takes place. This phenomenon is generally called sulfide stress corrosion cracking.

As countermeasures against the above-mentioned sulfide stress corrosion cracking, it has conventionally been recommended to use steels having hardnesses lower than a certain level or to completely temper steels into tempered martensite structures because the sulfide stress corrosion cracking susceptibility of steels is heavily dependent on the strengths (i.e., hardnesses) of the steels. Additionally, it has also been attempted to reduce the segregation of impurity elements, e.g., P or to lower the contents of relative large impurities.

SUMMARY OF THE INVENTION

The present inventors have unexpectedly found that it is effective as a countermeasure against such suflide stress corrosion cracking to cause ultrafine carbonitride particles to precipitate in an amount larger than a certain level in a steel.

An object of this invention is thus to provide a rolled steel having excellent resistance to sulfide stress corrosion cracking.

Another object of this invention is to provide a process for producing such a rolled steel.

In one aspect of this invention, there is accordingly provided a rolled steel having excellent resistance to sulfide stress corrosion cracking, which steel is characterized in that it comprises 0.20–0.40 wt.% C, ≦0.50 wt.% Si, ≦1.90 wt.% Mn, ≦0.06 wt.% Al, 0.0030–0.0090 wt.% N, 0.005–0.10 wt.% Nb, 0.005–0.050 wt.% Ti and the balance iron with the inevitable impurities. Also, most importantly it contains at least $4\times10^8$ ultrafine carbonitride particlesof 0.1 μm or smaller per $mm^3$.

In another aspect of this invention, there is also provided a process for producing a rolled steel having excellent resistance to sulfide stress corrosion cracking, which process comprises soaking a bloom or slab containing 0.20–0.40 wt.% C, <0.50 wt.% Si, <1.90 wt.% Mn, <0.06 wt.% Al, 0.0030–0.0090 wt.% N, 0.005–0.10 wt.% Nb, 0.005–0.50 wt.% Ti and the balance iron with the inevitable impurities, subjecting the thus-soaked bloom or slab to rough rolling at 1200°–950° C. under conditions of a total reduction percentage of 75% or lower, cooling the thus-rolled steel at a cooling rate of 1.5° C./sec. or higher after completion of the rough rolling and until the initiation of finish rolling, and then completing its final rolling above the $A_1$ transformation temperature so that at least $4\times10^8$ ultrafine carbonitride particles of 0.1 μm or smaller are present per $mm^3$ of said rolled steel.

Owing to the presence of a number of ultrafine carbonitride particles, the rolled steel according to this invention can exhibit excellent resistance to sulfide stress corrosion cracking.

The above and other objects, features and advantages of the present invention will become apparent from the following description and the appended claims, taken in conjunction with the accompanying drawings.

DETAILED DESCRIPTION OF THE INVENTION AND PREFERRED EMBODIMENTS

Figure 1:
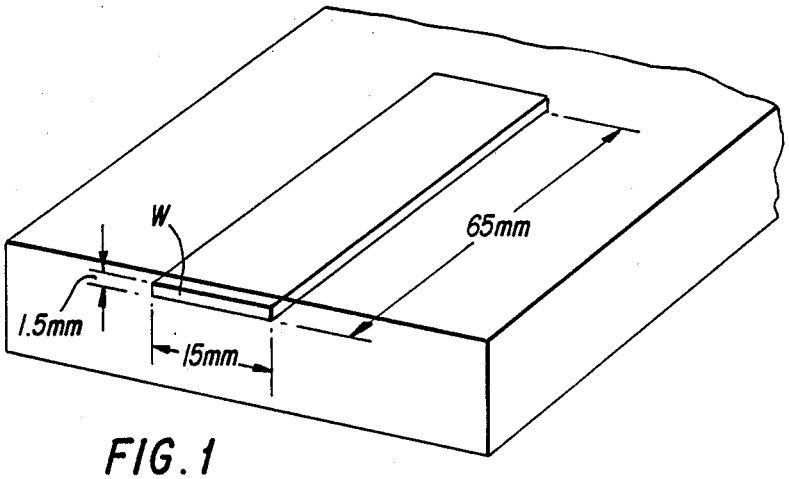
FIG. 1 is a schematic illustration showing the way of cutting specimens.

Ultrafine carbonitride particles in the present invention are present primarily in the forms of Ti(C,N) and Nb(C,N). Accordingly, the basic components C, N, Ti and Nb are controlled within the following ranges respectively.

The element C is an inexpensive strength-imparting element. It is added to a concentration of 0.20% or more in order to provide a desired level of strength. Its upper content limit is however set at 0.40% because any excess inclusion of C raises the precipitation temperature of carbonitrides, induces formation of very coarse carbonitride particles or even grains and thus lowers the resistance to sulfide stress corrosion cracking.

Beside C, the element N is also a basic element in the present invention. Since it is effective for the improvement of resistance to the sulfide stress corrosion cracking, it is necessary to add at least 0.0030% N. However, any excess addition of N will result in an increase of the precipitation-starting temperature of each carbonitride, thereby leading to the formation of very coarse carbonitride particles and correspondingly to a decrease in resistance to the sulfide stress corrosion cracking. Therefore, the upper content limit should be 0.0090% for N.

The element Nb not only improves the strength and toughness of a steel but also serves, when allowed to be present together with Ti, to form ultrafine carbonitride particles and thus to significantly impede the sulfide stress corrosion cracking susceptibility of the steel provided that the steel is suitably rolled. It is thus necessary to add at least 0.005% Nb, but any excess addition of Nb renders the precipitation-starting temperature of each carbonitride higher. As a result, the crystal growths of carbonitrides are promoted, thereby tending to deteriorate resistance to the sulfide stress corrosion cracking. Accordingly, the upper content limit of Nb should be 0.10%.

The element Ti is particularly effective, when allowed to be present together with Nb, in improving the resistance of a steel to the sulfide stress corrosion cracking. Thus, it is required to add Ti in an amount of 0.005% or more. Any excess inclusion of Ti, however, renders the precipitation-starting temperature of each carbonitride higher, similar to Nb. Thus, the intended distributed precipitation of fine carbonitrides will be reduced, resulting in a decrease in the resistance to the sulfide stress corrosion cracking. Accordingly, the upper content limit of Ti should be set at 0.050%.

Besides, Si, Mn and Al components are usually added principally as deoxidizers in the course of each steel-making process. Care must be taken on the following points when incorporating such elements.

The element Si is employed as a deoxidizer upon making a steel. Any excess addition of Si will however induce lowered toughness. Therefore, its incorporation should be kept at a level not higher than 0.50%.

The element Mn is effective for the improvement of strength. However, any excess incorporation of Mn will become a cause for the development of segregation in ingots or the formation of abnormal structures upon rolling the resultant steel, leading to a decrease in the resistance to the sulfide stress corrosion cracking. Therefore, the content of Mn should be controlled at a level not higher than 1.90%.

The element Al is effective for deoxidation or in reducing crystalline particles into ultrafine particles upon making a steel. However, it undergoes a reaction with N present in a steel and thus forms AlN, thereby impeding the formation of ultrafine carbonitride particles. Accordingly, the content of Al should be kept below 0.06%.

Besides, P and S are also contained as impurities. They act to lower the quality of a steel. Therefore, their contents should each be controlled below 0.03%.

Needless to say, it is feasible to add, in order to impart additional desirable properties, at least one mechanical property-improving element selected from the group consisting of Ni, Cr, Mo and V to the above-described system of components which permit precipitation of carbonitrides. In addition, it is also possible to incorporate at least one element capable of improving the resistance to the sulfide stress corrosion cracking, which element is selected from the group consisting of Cu, Ca and REM. It is effective to incorporate such additional elements in combination. Care should however be taken not to deteriorate the resistance to the sulfide stress corrosion cracking when the former mechanical property-improving element or elements are to be incorporated.

The element Ni has a distinct effect for the improvement of toughness. On the other hand, it promotes the formation of a martensite structure which has high cracking susceptibility. Accordingly, its content should be controlled below 0.30%.

The elements Cr and Mo are effective for improving the strength and corrosion resistance. However, any excess additions of these elements are accompanied by dangers. Namely, the sulfide stress corrosion cracking susceptibility will be increased when the former element is incorporated too much, while any excess addition of the latter element deteriorates the corrosion resistance of each steel in corrosive $H_2S$ environments. Accordingly, the upper content limits must be set at 0.8% for the former element and at 0.50% for the latter element.

The element V is effective in enhancing the strength of each steel. However, it lowers the toughness of the steel at welded parts when added in a large amount. Thus, its content should be controlled below 0.10%.

The element Cu serves to improve the corrosion resistance of each rolled steel in relatively-mild corrosive environments. Any excess addition of Cu tends to induce the development of cracks under the rolling conditions of this invention. Accordingly, its content should be controlled below 0.30%.

The element Ca serves to suppress the formation of elongated sulfide-type impurities in steel, thereby improving the resistance to the sulfide stress corrosion cracking. However, any excess addition of Ca leads to deterioration in steel quality. Accordingly, the content of Ca should be kept below 0.005%.

REM, namely, rare earth elements (for example, La, Ce) serve to make shapes of sulfide-type impurities present in a steel spherical, thereby improving the resistance to the sulfide stress corrosion cracking. Any excess addition of REM however tend to develop segregation in a lower part of each steel ingot and to trigger internal defects. Thus, its content should be kept below 0.020%.

The rolling conditions will hereinafter be described.

A bloom or slab of the above-mentioned C-N-Ti-Nb system is soaked in the austenized temperature region for its subsequent rough rolling. A total reduction percentage of 75% or lower is then imparted, because a reduction percentage which is considered to be necessary for the improvement of mechanical properties in finish rolling cannot be secured if the total reduction percentage should exceed 75%. This serves to convert crystalline particles into ultrafine particles and to suppress the precipitation of very coarse carbonitrides in a high-temperature range.

After rough rolling, the steel is then subjected to finish rolling. Here, the cooling rate of the steel should be controlled at 1.5° C./sec. or higher after completion of the rough rolling and until the initiation of finish rolling. This cooling rate is effective in minimizing the precipitation of carbonitrides before the finish rolling and in impeding the growth of such carbonitrides. Needless to say, it is desirous for the reasons mentioned above to make the cooling rate of each steel plate faster from the soaking temperature to the final temperature of its rough rolling upon carrying out its rough rolling, compared with the cooling rate employed in the usual controlled-rolling method. Any cooling rates faster than 10° C./sec. involve a danger of forming abnormal structures and the cooling rate should preferably be controlled within the range of 1.5°–10° C./sec.

Next, the thus-rolled steel is subjected to finish rolling. Since the carbonitrides, which have been formed into solid solution owing to the above-controlled rolling conditions, are in a saturated state, these carbonitrides are caused to precipitate at a concentration of $4\times10^8$ pieces per $mm^3$ or more and in a distributed ultrafine state of 0.1 μm or smaller by the finish rolling. It is important to finish the rolling above the $A_1$ transformation temperature, because ferrite is converted into a worked and crushed structure at temperatures lower than the $A_1$ transformation temperature.

Such a hot-rolled steel may be used as a final product without any further treatment or processing. It is however preferable to heat it again to a temperature higher by 30°–120° C. than the $A_3$ transformation temperature to carry out its quenching or normalization and then to temper same from a temperature lower by 30°–120° C. than the $A_1$ transformation temperature. This additional processing provides a tempered martensite structure having excellent resistance to the sulfide stress corrosion cracking and, at the same time, assures improvements to the mechanical properties of the hot-rolled steel.

The invention will hereinafter be described specifically in the following Example and Comparative Example.

EXAMPLE

Hot-rolled steels and heat-treated steels were produced from their respective steel samples (Nos. 1–14) given in Table 1 under the rolling conditions summarized in Table 2. From each of the thus-produced steels, a specimen illustrated in FIG. 1—1.5 mm thick, 15 mm wide and 65 mm long—was formed and then subjected to a sulfide stress corrosion cracking test.

Figure 2:
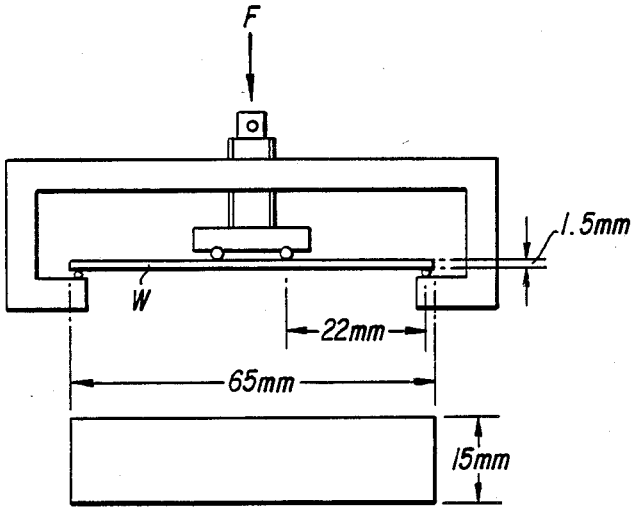
FIG. 2 is a schematic illustration of a stress load testing apparatus.

The sulfide stress corrosion cracking test was carried out in the following manner. Using the jig illustrated in FIG. 2, a predetermined stress was applied continuously to each specimen while holding the specimen at room temperature and for 700 hours in an NACE solution (an aqueous 0.5% acetic acid and 5% NaCl solution saturated with $H_2S$) or a KS solution (an aqueous 0.5% acetic acid and 5% NaCl solution saturated with 3 atm. $H_2S$). A cross-sectional profile of the specimen was observed by means of a metallurgical microscope (magnification: ×200) to determine whether cracks had been developed or not. Results are shown also in Table 2, in which the cracking susceptibility is expressed by ◎ : none of the four specimens was cracked; ○ : one of the four specimens was cracked; Δ: two of the four specimens were cracked; and X: three to four of the four specimens were cracked.

COMPARATIVE EXAMPLE

Steel sample Nos. 15–18 (free of Ti or Nb component) and steel sample Nos. 19–22 (cooled at cooling rates outside the present invention), each shown in Table 3, were worked and treated under the conditions given in Table 4, thereby obtaining hot-rolled steels and heat-treated steels respectively. Specimens similar to those prepared in the Example were formed from their corresponding steels and subjected to the same sulfide stress corrosion cracking test as effected in the above Example. Results are shown also in Table 4.

TABLE 1

| | Chemical Compositions of Steel Samples | | | | | | | | | | | | | | | |
|---|---|---|---|---|---|---|---|---|---|---|---|---|---|---|---|---|
| No. | C | Si | Mn | P | S | Al | Nb | Ti | Ni | Cr | Mo | Cu | REM | Ca | V | N | Remarks |
| 1 | .30 | .23 | 1.38 | .010 | .007 | .040 | .013 | .008 | | | | | | | | .0069 | Invention sheet |
| 2 | .29 | .25 | 1.41 | .010 | .008 | .039 | .029 | .007 | .22 | | | | | | | .0061 | " |
| 3 | .34 | .26 | 1.58 | .011 | .008 | .047 | .065 | .007 | | .53 | | | | | | .0083 | " |
| 4 | .30 | .33 | 1.37 | .012 | .004 | .024 | .025 | .011 | | | | | | | .035 | .0051 | " |
| 5 | .28 | .28 | .86 | .008 | .004 | .024 | .040 | .011 | | .72 | .25 | | | | | .0058 | " |
| 6 | .29 | .29 | 1.42 | .016 | .008 | .034 | .030 | .010 | | | | | | .0026 | | .0060 | " |
| 7 | .30 | .27 | 1.25 | .012 | .007 | .025 | .029 | .010 | | | | | .009 | | | .0053 | " |
| 8 | .30 | .27 | 1.60 | .010 | .008 | .052 | .029 | .014 | | | | .14 | | .0024 | | .0045 | " |
| 9 | .29 | .26 | 1.57 | .009 | .008 | .043 | .022 | .016 | | | | | .010 | .0024 | | .0040 | " |
| 10 | .29 | .29 | .82 | .011 | .009 | .020 | .026 | .011 | | | | | .007 | | .045 | .0049 | " |
| 11 | .32 | .25 | 1.21 | .013 | .008 | .049 | .024 | .013 | | .50 | | | | .0026 | | .0045 | " |
| 12 | .30 | .29 | .92 | .013 | .006 | .039 | .021 | .009 | | .54 | | .22 | | .0029 | | .0058 | " |
| 13 | .26 | .30 | .86 | .012 | .006 | .033 | .024 | .011 | .25 | .52 | .38 | .22 | .015 | | | .0053 | " |
| 14 | .28 | .31 | 1.37 | .010 | .007 | .054 | .026 | .016 | | .54 | | .19 | | .0026 | .040 | .0041 | " |

TABLE 2

| | Heat Treatment and Processing Conditions and Mechanical Properties | | | | | | | | | |
|---|---|---|---|---|---|---|---|---|---|---|
| No. | Cooling rate (°C./sec.) | Finish rolling temp. (°C.) | Quenching temp. (°C.) | Tempering temp. (°C.) | Yield point ($kgf/mm^2$) | Tensile strength ($kgf/mm^2$) | Elongation (%) | No. of ultra-fine carbo-nitride particles ($\times 10^8$) | Cracking susceptibility* 1 atm. | Cracking susceptibility* 3 atm. |
| 1 | 1.6 | 840 | 900 | 630 | 57.8 | 67.3 | 21.0 | 6.0 | ○ | ○ |
| 2 | 1.5 | 870 | 900 | 630 | 58.3 | 68.6 | 21.1 | 8.6 | ○ | Δ |
| 3 | 1.8 | 810 | 875 | 620 | 69.2 | 79.0 | 19.3 | 12.6 | ○ | Δ |
| 4 | 1.5 | 810 | 925 | 640 | 58.8 | 68.6 | 20.7 | 10.3 | ○ | Δ |
| 5 | 1.7 | 840 | 875 | 670 | 57.8 | 68.3 | 21.1 | 13.2 | ○ | ○ |
| 6 | 1.7 | 870 | 925 | 640 | 58.3 | 67.6 | 21.4 | 11.0 | ○ | ○ |
| 7 | 1.6 | 840 | 925 | 630 | 53.5 | 64.5 | 21.2 | 10.5 | ○ | ○ |
| 8 | 2.0 | 840 | 875 | 640 | 61.8 | 70.8 | 19.4 | 13.6 | ○ | ○ |
| 9 | 1.9 | 870 | 875 | 630 | 62.8 | 70.9 | 19.7 | 12.5 | ○ | ○ |
| 10 | 1.7 | 840 | 900 | 690 | 52.4 | 62.2 | 21.8 | 10.8 | ◎ | ◎ |
| 11 | 1.6 | 870 | 900 | 630 | 63.7 | 72.9 | 20.0 | 11.9 | ◎ | ◎ |
| 12 | 1.5 | 810 | 900 | 660 | 60.9 | 70.6 | 20.6 | 8.2 | ◎ | ◎ |
| 13 | 1.7 | 810 | 900 | 630 | 63.2 | 72.1 | 20.2 | 10.3 | ◎ | ○ |
| 14 | 1.9 | 870 | 900 | 630 | 65.5 | 74.7 | 19.8 | 13.7 | ○ | ○ |

Note:
Each of steel samples Nos. 1–14 was rolled with the rough rolling-starting temperature of 1100° C. to give the draft percentage of 70%.
*Cracking susceptibility at $H_2S$ partial pressures of 1 atm. and 3 atm.

TABLE 3

| | Chemical Compositions of Steel Samples | | | | | | | | | | | | | | | |
|---|---|---|---|---|---|---|---|---|---|---|---|---|---|---|---|---|
| No. | C | Si | Mn | P | S | Al | Nb | Ti | Ni | Cr | Mo | Cu | REM | Ca | V | N | Remarks |
| 15 | .31 | .28 | 1.42 | .008 | .005 | .040 | | | | | | | | | | .0041 | Comparative sheet |
| 16 | .32 | .26 | 1.39 | .012 | .006 | .041 | .015 | | | | | | | | | .0043 | " |
| 17 | .26 | .32 | .54 | .010 | .007 | .014 | | | .23 | .74 | .41 | | | | | .0073 | " |
| 18 | .31 | .24 | .87 | .007 | .006 | .034 | | .008 | .22 | .63 | .28 | | | | | .0047 | " |
| 19 | .33 | .30 | 1.56 | .012 | .006 | .046 | .016 | .010 | | .57 | | | | | | .0058 | " |
| 20 | .31 | .26 | 1.41 | .018 | .005 | .033 | .025 | .015 | | | | | | .0029 | | .0067 | " |
| 21 | .32 | .25 | 1.41 | .011 | .007 | .038 | .057 | .009 | | .48 | | .18 | | .0020 | | .0047 | " |

TABLE 3-continued

| | Chemical Compositions of Steel Samples | | | | | | | | | | | | | | | | |
|---|---|---|---|---|---|---|---|---|---|---|---|---|---|---|---|---|---|
| No. | C | Si | Mn | P | S | Al | Nb | Ti | Ni | Cr | Mo | Cu | REM | Ca | V | N | Remarks |
| 22 | .31 | .29 | 1.58 | .011 | .005 | .044 | .015 | .017 | | .53 | | | .008 | .0021 | | .0045 | " |

TABLE 4

| | Heat Treatment and Processing Conditions and Mechanical Properties | | | | | | | | | |
|---|---|---|---|---|---|---|---|---|---|---|
| No. | Cooling rate (°C./sec.) | Finish rolling temp. (°C.) | Quenching temp. (°C.) | Tempering temp. (°C.) | Yield point (kgf/mm$^2$) | Tensile strength (kgf/mm$^2$) | Elongation (%) | No. of ultrafine carbonitride particles ($\times 10^8$) | Cracking susceptibility* 1 atm. | 3 atm. |
| 15 | 1.6 | 840 | 900 | 640 | 59.3 | 68.5 | 19.8 | — | X | X |
| 16 | 1.5 | 870 | 900 | 630 | 59.8 | 69.3 | 20.1 | 1.3 | X | X |
| 17 | 1.7 | 870 | 900 | 630 | 62.6 | 71.3 | 19.4 | — | X | X |
| 18 | 1.5 | 840 | 900 | 630 | 63.8 | 75.8 | 18.6 | 1.4 | X | X |
| 19 | 0.9 | 870 | 875 | 640 | 70.2 | 78.4 | 18.0 | 1.2 | X | X |
| 20 | 1.2 | 840 | 900 | 650 | 59.5 | 67.9 | 19.5 | 3.6 | O | Δ |
| 21 | 1.2 | 840 | 875 | 640 | 64.2 | 75.0 | 18.6 | 2.5 | Δ | X |
| 22 | 1.0 | 870 | 875 | 640 | 67.6 | 77.4 | 17.8 | 2.6 | Δ | X |

Note:
Each of steel samples Nos. 15–22 was rolled with the rough rolling-starting temperature of 1100°C. to give the draft percentage of 70%.
*Cracking susceptibility at $H_2S$ partial pressures of 1 atm. and 3 atm.

As apparent from the results given in Tables 2 and 4, the comparative steel Nos. 15–18 in which Ti and Nb were not added in combination, it is noted that the combined incorporation of Ti and Nb is a feature of this invention, each developed cracks in the sulfide stress corrosion cracking tests. On the other hand, the comparative steel Nos. 19–22 in which Ti and Nb were added in combination but the cooling rates were slower compared with those employed for the invention steels developed less precipitation of ultrafine carbonitride particles and their resistance to the sulfide stress corrosion cracking was not sufficient.

On the other hand, the invention steels, i.e., the steel sample Nos. 1–14 Ti, Nb, C and N at suitable levels and were subjected to rolling work under conditions within the scope of this invention. As a result, they allowed a great deal of ultrafine carbonitride particles to precipitate, thereby indicating that excellent resistance to the sulfide stress corrosion cracking was achieved.

Having now fully described the invention, it will be apparent to one or ordinary skill in the art that many changes and modifications can be made thereto without departing from the spirit or scope of the invention as set forth herein.

What is claimed is:

1. A method of producing a rolled steel having excellent resistance to sulfide stress corrosion cracking, said steel having at least $4\times10^8$ ultrafine carbonitride particles of 0.1 μm or smaller per mm$^3$; and wherein said rolled steel consists essentially of 0.20–0.40 wt.%C, ≦0.50 wt.% Si, ≦1.90 wt.% Mn, ≦0.060 wt.% of Al, 0.0030–0.0090 wt.% N, 0.005–0.10 wt.% Nb, 0.005–0.050 wt.% Ti, at least one component selected from the group consisting of ≦0.30 wt.% Ni, ≦0.80 wt.% Cr, ≦0.50 wt.% Mo and ≦0.10 wt.% of V, with the balance being iron and inevitable impurities; said method comprising:

(a) soaking a bloom or slab having the above-described components, (b) rough rolling at 950°–1200° C. under conditions of a total reduction percentage of 75% or lower, (c) cooling at a cooling rate of 1.5° C./sec. or higher after completion of the rough rolling and until the initiation of final rolling at 870° C. or below but above the $A_1$ transformation temperature, and (d) final rolling at 870° C. or below but above the $A_1$ transformation temperature.

2. The method according to claim 1, wherein said cooling step (c) is conducted in a range of about 1.5° to 10° C./sec.

3. The method according to claim 1, wherein said rolled alloy further contains at least one component selected from the group consisting of ≦0.30 wt. % Cu, ≦0.020 wt. % of one or more rare earth metals and ≦0.005 wt. % of Ca.

4. The method according to claim 3, wherein said cooling step (c) is conducted in a range of about 1.5° to 10° C./sec.

5. A method of producing a rolled steel having excellent resistance to sulfide stress corrosion cracking, said steel having at least $4\times10^8$ ultrafine carbonitride particles of 0.1 μm or smaller per mm$^3$; and wherein said rolled steel consists essentially of 0.20–0.40 wt.%C, ≦0.50 wt.% Si, ≦1.90 wt.% Mn, ≦0.060 wt.% Al, 0.0030–0.0090 wt.% N, 0.005–0.10 wt.% Nb, 0.005–0.050 wt.% Ti, at least one component selected from the group consisting of ≦0.30 wt.% Ni, ≦0.80 wt.% Cr, ≦0.50 wt.% Mo and ≦0.10 wt.% of V, with the balance being iron and inevitable impurities; said method comprising:

(a) soaking a bloom or slab having the above-described components, (b) rough rolling at 950°–1200° C. under conditions of a total reduction percentage of 75% or lower, (c) cooling at a cooling rate of 1.5° C./sec. or higher after completion of the rough rolling and until the initiation of final rolling at 870° C. or below but above the $A_1$ transformation temperature, (d) final rolling at 870° C. or below but above the $A_1$ transformation temperature, (e) heating to a temperature higher by 30°–120° C. than the $A_3$ transformation temperature, (f) quenching or normalizing, and then (g) tempering the steel from a temperature lower by 30°–120° C. than the $A_1$ transformation temperature.

6. The method according to claim 5 wherein said cooling step (c) is conducted in a range of about 1.5° to 10° C./sec.

7. The method according to claim 5, wherein said rolled alloy further contains at least one component selected from the group consisting of ≦0.30 wt. % Cu, ≦0.020 wt. % of one or more rare earth metals and ≦0.005 wt. % of Ca.

8. The method according to claim 7, wherein said cooling step (c) is conducted in a range of 1.5° to 10° C./sec.

9. A method of producing a rolled steel having excellent resistance to sulfide stress corrosion cracking, said steel having at least $4\times10^8$ ultrafine carbonitride particles of 0.1 μm or smaller per $mm^3$; and wherein said rolled steel consists essentially of 0.20–0.40 wt.% C, ≦0.50 wt.% Si, ≦1.90 wt.% Mn, ≦0.060 wt.% of Al, 0.0030–0.0090 wt.% N, 0.005–0.10 wt.% Nb, 0.005–0.050 wt.% Ti, at least one component selected from the group consisting of ≦0.30 wt.% Ni, ≦0.80 wt.% Cr, ≦0.50 wt.% Mo and ≦0.10 wt.% of V, with the balance being iron and inevitable impurities; said method comprising:

(a) soaking a bloom or slab having the above-described components, (b) rough rolling at 950°–1200° C. under conditions of a total reduction percentage of 75% or lower while retaining the carbonitride in solid solution, (c) cooling at a cooling rate of 1.5° C./sec. or higher after completion of the rough rolling to a temperature at which at least $4\times10^8$ ultrafine carbonitride particles of 0.1 μm or smaller per $mm^3$ in a rolled steel can form when the steel is final rolled and until the initiation of final rolling, and (d) final rolling at a temperature at which at least $4\times10^8$ ultrafine carbonitride particles of 0.1 μm or smaller per $mm^3$ in the rolled steel can form when the steel is final rolled above the $A_1$ transformation temperature.

10. The method according to claim 9, wherein said cooling step (c) is conducted in a range of about 1.5° to 10° C./sec.

11. The method according to claim 9, wherein said rolled alloy further contains at least one component selected from the group consisting of ≦0.30 wt.% Cu, ≦0.020 wt.% of one or more rare earth metals and ≦0.005 wt.% of Ca.

12. The method according to claim 11, wherein said cooling step (c) is conducted in a range of about 1.5° to 10° C./sec.

13. A method of producing a rolled steel having excellent resistance to sulfide stress corrosion cracking, said steel having at least $4\times10^8$ ultrafine carbonitride particles of 0.1 μm or smaller per $mm^3$; and wherein said rolled steel consists essentially of 0.20–0.40 wt.%C, ≦0.50 wt.% Si, ≦1.90 wt.% Mn, ≦0.060 wt.% Al, 0.0030–0.0090 wt.% N, 0.005–0.10 wt.% Nb, 0.005–0.050 wt.% Ti, at least one component selected from the group consisting of ≦0.30 wt.% Ni, ≦0.80 wt.% Cr, ≦0.50 wt.% Mo and ≦0.10 wt.% of V, with the balance being iron and inevitable impurities; said method comprising:

(a) soaking a bloom or slab having the above-described components, (b) rough rolling at 950°–1200° C. under conditions of a total reduction percentage of 75% or lower while retaining the carbonitrides in solid solution, (c) cooling at a cooling rate of 1.5° C./sec. or higher after completion of the rough rolling to a temperature at which at least $4\times10^8$ ultrafine carbonitride particles of 0.1 μm or smaller per $mm^3$ in the rolled steel can form when the steel is final rolled above the $A_1$ transformation temperature, (d) final rolling at a temperature at which at least $4\times10^8$ ultrafine carbonitride particles of 0.1 μm above the $A_1$ transformation temperature, or smaller per $mm^3$ in the rolled steel can form when the steel is final rolled above the $A_1$ transformation temperature, (e) heating to a temperature higher by 30°–120° C. than the $A_3$ transformation temperature, (f) quenching or normalizing, and then (g) tempering the steel from a temperature lower by 30°–120° C. than the $A_1$ transformation temperature.

14. The method according to claim 13, wherein said cooling step (c) is conducted in a range of about 1.5° to 10° C./sec.

15. The method according to claim 13, wherein said rolled alloy further contains at least one component selected from the group consisting of ≦0.30 wt.% Cu, ≦0.020 wt.% of one or more rare earth metals and ≦0.005 wt.% of Ca.

16. The method according to claim 15, wherein said cooling step (c) is conducted in a range of 1.5° to 10° C./sec.

* * * * *